US007131173B2

(12) United States Patent
Hirasawa et al.

(10) Patent No.: US 7,131,173 B2
(45) Date of Patent: Nov. 7, 2006

(54) METHOD OF FABRICATING AN INKJET HEAD

(75) Inventors: Taku Hirasawa, Kyoto (JP); Akiko Murata, Osaka (JP); Eiji Fujii, Osaka (JP); Hideo Torii, Osaka (JP); Tohru Nakagawa, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 144 days.

(21) Appl. No.: 10/506,750

(22) PCT Filed: Dec. 8, 2003

(86) PCT No.: PCT/JP03/15643

§ 371 (c)(1),
(2), (4) Date: Sep. 3, 2004

(87) PCT Pub. No.: WO2004/052651

PCT Pub. Date: Jun. 24, 2004

(65) Prior Publication Data

US 2005/0168535 A1 Aug. 4, 2005

(30) Foreign Application Priority Data

Dec. 10, 2002 (JP) ..... 2002-357583

(51) Int. Cl.
*H04R 17/00* (2006.01)
*B21D 53/76* (2006.01)
*B44C 1/22* (2006.01)

(52) U.S. Cl. ..... 29/25.35; 29/890.1; 29/846; 29/DIG. 16; 29/DIG. 19; 216/27; 216/52; 451/28; 451/41; 347/47; 347/70; 347/71

(58) Field of Classification Search ..... 29/25.35, 29/890.1, 846, DIG. 16, DIG. 19; 216/27, 216/52; 347/20, 47, 48, 68, 70, 71; 451/28, 451/41
See application file for complete search history.

(56) References Cited

U.S. PATENT DOCUMENTS 6,988,316 B1 * 1/2006 Kweon et al. ..... 29/890.1
2002/0180840 A1 12/2002 Matsumoto et al.

FOREIGN PATENT DOCUMENTS

JP 2-263653 * 10/1990 ..... 29/890.1
JP 10286960 A 10/1998
JP 2001-130011 A 5/2001

OTHER PUBLICATIONS

Hock et al., "Designing a Fluid Pump for Microfluidic Cooling Systems in Electronic Components", Electronic Packaging Technology Conference, IEEE Proceedings 1997, Oct. 8-10, 1997, pp. 115-118.*
International Search Report for PCT/JP03/15643, mailed Mar. 23, 2004; ISA/JPO.

* cited by examiner

*Primary Examiner*—A. Dexter Tugbang
(74) *Attorney, Agent, or Firm*—Harness, Dickey & Pierce, P.L.C.

(57) ABSTRACT

First, a first electrode layer 4, a piezoelectric layer 5, a second electrode layer 6 and an oscillation layer 7 are stacked in this order over one surface of a silicon substrate 1. Next, an ink chamber partition 8 and a nozzle plate 11 are stacked over the oscillation layer 7. Subsequently, the silicon substrate 1 is ground away to a predetermined thickness from a surface thereof opposite to the first electrode layer 4, and then a remnant silicon substrate 13 is dry etched away. Thereafter, the first electrode layer 4 is patterned to form a plurality of inkjet mechanisms 2, 2, . . . . Finally, the plurality of inkjet mechanisms 2, 2, . . . are divided to simultaneously fabricate a plurality of inkjet heads 3, 3, . . . .

2 Claims, 5 Drawing Sheets

METHOD OF FABRICATING AN INKJET HEAD

TECHNICAL FIELD

The present invention relates to a method for fabricating an inkjet head for forming characters, images and the like on a recording medium by discharging ink drops from a nozzle due to deformation of a piezoelectric element, and an inkjet recording apparatus including an inkjet head fabricated by this method.

BACKGROUND ART

Conventionally, an inkjet mechanism for carrying out recording by impacting ink drops on a recording medium is known. This inkjet mechanism includes: a head layer formed by sequentially stacking a first electrode layer, a piezoelectric layer, a second electrode layer and an oscillation layer; an ink chamber partition formed on the oscillation layer of the head layer; and a nozzle plate formed on the ink chamber partition and provided with a nozzle. A space, defined by the head layer, the ink chamber partition and the nozzle plate, forms an ink chamber in which ink is contained. Further, in the inkjet mechanism, upon application of voltage between the first and second electrode layers, the piezoelectric effect of the piezoelectric layer causes the deformation of the head layer and the ink contained in the ink chamber is pressurized, thus discharging the ink from the nozzle.

Actually, the height of the ink chamber in a thickness direction thereof affects the discharge: speed of ink and/or response speed. Therefore, if high definition printing is carried out using an inkjet head that is formed by arranging a large number of inkjet mechanisms, it is preferable that variations in the heights of the respective ink chambers are slight. Furthermore, an ink chamber with an extremely great height causes a reduction in the discharge speed of ink, and is thus not suitable for the inkjet mechanism.

Now, conventional inkjet head fabricating methods are broadly divided into two kinds of methods, i.e., a method for forming an ink chamber by processing a substrate (see FIG. 4) and a method for forming an ink chamber by using a member other than a substrate instead of processing the substrate (see FIG. 5).

In the former method, as shown in FIG. 4A, first, an oscillation layer 101, a first electrode layer 102, a piezoelectric layer 103, and a second electrode layer 104 are stacked in this order over one surface of a substrate 100, thereby forming a head layer 105. Next, as shown in FIG. 4B, a part of the substrate 100 corresponding to an ink chamber 106 is etched away from a surface of the substrate 100 opposite to the head layer 105, thereby forming an ink chamber partition 107. Finally, a nozzle plate 109 provided with an ink discharge opening 108 is bonded onto the ink chamber partition 107 using an adhesive 110 (see Japanese Unexamined Patent Publication No. 10-286960). In this method, the thickness of the substrate 100 is the height of the ink chamber 106 as it is.

Actually, if a plurality of inkjet heads are fabricated on a substrate in order to mass-produce the inkjet heads by employing the former method, it is necessary to use a thin substrate having a large area. However, such a thin substrate having a large area can be very easily broken, and thus the yield is decreased. Therefore, in order to prevent the breakage of a substrate, the following method is proposed: a thick substrate is prepared, a head layer is formed on the substrate, the substrate is polished and thinned, and then an ink chamber is formed. However, since a piezoelectric layer is generally deposited at a high temperature, the substrate is warped at room temperature due to a thermal expansion coefficient difference and/or an internal stress of the piezoelectric layer. Thus, it is difficult to polish the substrate so as to uniformize the thickness thereof. Accordingly, in this method, the heights of ink chambers differ between the simultaneously fabricated inkjet heads, and as a result, there occurs the problem that the printing characteristics differ between the inkjet heads. Because of the above reasons, the former method is not suitable for the mass production of inkjet heads.

On the other hand, in the latter method, as shown in FIG. 5A, first, a first electrode layer 201, a piezoelectric layer 202, a second electrode layer 203, and an oscillation layer 204 are stacked in this order over one surface of a substrate 200, thereby forming a head layer 205. Next, an ink chamber partition 206 and a nozzle plate 208 provided with an ink discharge opening 207 are sequentially bonded onto the oscillation layer 204 of the head layer 205 via adhesives 209, 210. Finally, as shown in FIG. 5B, the substrate 200 is removed by chemical etching. This chemical etching includes wet etching and/or dry etching. According to this method, since the heights of ink chambers can be equalized irrespective of the thickness and/or area of the substrate 200, it is possible to simultaneously fabricate a plurality of inkjet heads in which variations in the heights of the ink chambers are slight. Therefore, in mass-producing the inkjet heads, it is preferable to fabricate them by the latter method.

-Problems that the Invention is to Solve-

However, in the latter method, since the substrate is increased in thickness in order to prevent the breakage of the substrate, a long period of time is required to etch away the substrate. Accordingly, the production efficiency of inkjet heads is reduced.

Further, since a period of time required for the removal of the substrate is long, the electrode layers, adhesives, piezoelectric layer, oscillation layer, ink chamber partition and nozzle plate are degraded during the removal, thus causing variations in ink discharge performance between the simultaneously fabricated inkjet heads.

Furthermore, in the case where dry etching is performed in removing the substrate, if there is contamination of a surface of the substrate subjected to dry etching, the contaminated portion is not dry etched, and as a result, the yield of the inkjet heads might be reduced.

The present invention has been made in view of the above points, and its object is to provide a technique for enabling the simultaneous mass production of inkjet heads in which variations in ink discharge performance are slight, in a method for fabricating an inkjet head including a plurality of piezoelectric elements, each having a first electrode layer, a piezoelectric layer, a second electrode layer and an oscillation layer, for pressurizing ink contained in a plurality of ink chambers to discharge the ink to a recording medium from a plurality of nozzles communicated with the respective ink chambers. Another object is to provide an inkjet recording apparatus in which printing irregularities are reduced during printing.

DISCLOSURE OF THE INVENTION

In order to achieve the above object, in a method for fabricating an inkjet head according to the present invention, an ink chamber is formed using a member other than a substrate instead of processing the substrate, and in addition to dry etching, mechanical grinding is utilized in removing the substrate.

Specifically, a first invention is a method for fabricating an inkjet head including a plurality of piezoelectric elements, each having a first electrode layer, a piezoelectric layer, a second electrode layer and an oscillation layer, for pressurizing ink contained in a plurality of ink chambers to discharge the ink to a recording medium from a plurality of nozzles communicated with the respective ink chambers. And the method is characterized by including the steps of: sequentially forming the first electrode layer, the piezoelectric layer, the second electrode layer and the oscillation layer over one surface of a substrate; forming, on the oscillation layer, an ink chamber partition for separating the plurality of ink chambers from each other; forming, on the ink chamber partition, a nozzle plate provided with the plurality of nozzles, thereby defining the plurality of ink chambers; after the ink chamber partition forming step, mechanically grinding away a part of the substrate from a surface thereof opposite to the first electrode layer; after the grinding away step, etching away a remnant substrate by performing chemical etching that allows selectivity; and after the etching away step, patterning at least the exposed first electrode layer so that its position corresponds to that of an associated one of the ink chambers, thereby forming the plurality of piezoelectric elements.

Thus, since the ink chambers are formed using the member other than the substrate instead of processing the substrate, the heights of the ink chambers can be equalized to a predetermined height. Therefore, the inkjet heads, in which variations in the heights of the ink chambers are slight, can be fabricated irrespective of the thickness and/or area of the substrate. Further, if a plurality of inkjet heads are simultaneously fabricated, it is possible to simultaneously fabricate a plurality of inkjet heads in which variations in the heights of the ink chambers are slight.

Furthermore, since the height of each ink chamber can be arbitrarily set, it is possible to set the height of each ink chamber such that ink is discharged at a high speed and the time period required for the charge of ink is shortened.

Moreover, in the present invention, since the ink chambers are formed using the member other than the substrate instead of processing the substrate, the substrate is completely removed. Therefore, in removing the substrate, in addition to etching that allows selective removal of only the substrate, it is possible to use mechanical grinding that does not allow selectivity but provides a high process speed. Accordingly, the time period required for the removal of the substrate can be significantly reduced, and thus the production efficiency of the inkjet heads can be improved.

Besides, since etching and grinding are both utilized in removing the substrate, the time period required for the etching is reduced. Thus, the degradation in the electrode layers, adhesives, piezoelectric layer, oscillation layer, ink chamber partition and nozzle plate is reduced. Accordingly, it becomes possible to reduce variations in ink discharge performance between the nozzles of the inkjet heads. Further, if a plurality of inkjet heads are simultaneously fabricated, it is possible to reduce variations in ink discharge performance between the simultaneously fabricated inkjet heads.

A second invention, based on the first invention, is characterized in that: the first electrode layer includes at least one of Pt, Ir, Pd, Au, Ni, Fe, Cu and Cr; and in the etching away step, the remnant substrate is dry etched away.

In the second invention, since the etch rate of Pt, Ir, Pd, Au, Ni, Fe, Cu and Cr is low during dry etching, it is possible to certainly remove only the substrate without removing the first electrode layer.

A third invention is an inkjet recording apparatus characterized by including: an inkjet head fabricated by utilizing the first invention; and relative movement means for causing relative movement between the inkjet head and recording medium.

-Effects of the Invention-

According to the present invention, since a substrate is removed by employing mechanical grinding in addition to dry etching, it is possible to simultaneously fabricate a plurality of inkjet heads with slight variations in the heights of ink chambers by utilizing a substrate having a large thickness, for example. Furthermore, it is possible to provide an inkjet recording apparatus in which printing irregularities are reduced during printing.

BEST MODE FOR CARRYING-OUT OF THE INVENTION

Hereinafter, an embodiment of the present invention will be described in detail with reference to the drawings.

Figure 1:
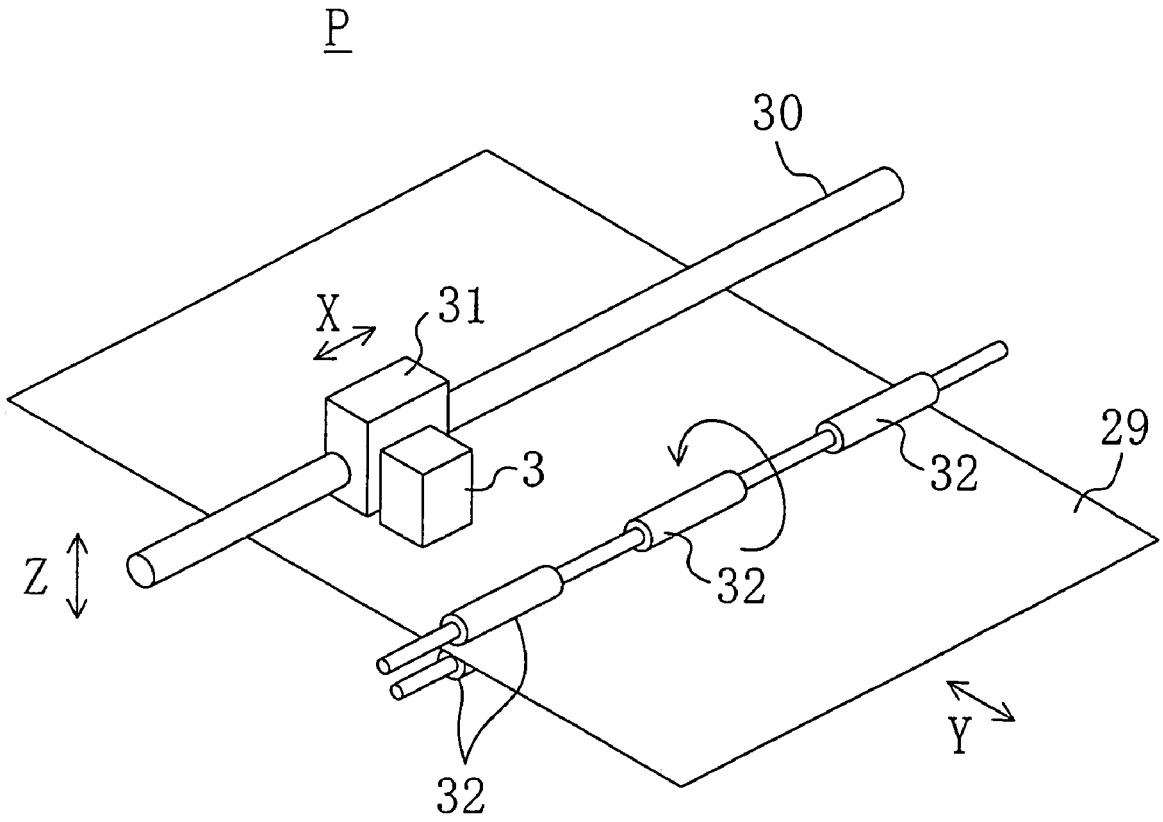
FIG. 1 is a diagram schematically illustrating the arrangement of an inkjet recording apparatus.

As shown in FIG. 1, an inkjet recording apparatus P according to the present embodiment includes: an inkjet head 3 for discharging ink drops to a recording medium 29 such as a recording paper by utilizing the piezoelectric effect of piezoelectric elements 14 (see FIG. 3); a carriage 31 for moving the inkjet head 3; and a carriage shaft 30 extending in a widthwise direction of the recording medium 29 (which will be hereinafter called a "primary scanning direction X"). The carriage 31 fixedly supports the inkjet head 3, and is movably supported on the carriage shaft 30. The carriage 31 is provided with a carriage motor (not shown), and the inkjet head 3 and carriage 31 are reciprocated along the carriage shaft 30 by driving this carriage motor. The recording medium 29 is sandwiched between three upper transport rollers 32 and three lower transport rollers 32, which are rotated by a transport motor (not shown). Further, due to the rotation of this transport motor, the recording medium 29 is transported in a secondary scanning direction Y that is approximately perpendicular to the primary scanning direction X. It should be noted that a relative movement means according to the present invention includes the carriage shaft 30, the carriage 31, the carriage motor, the transport motor and the transport rollers 32.

Figure 2:
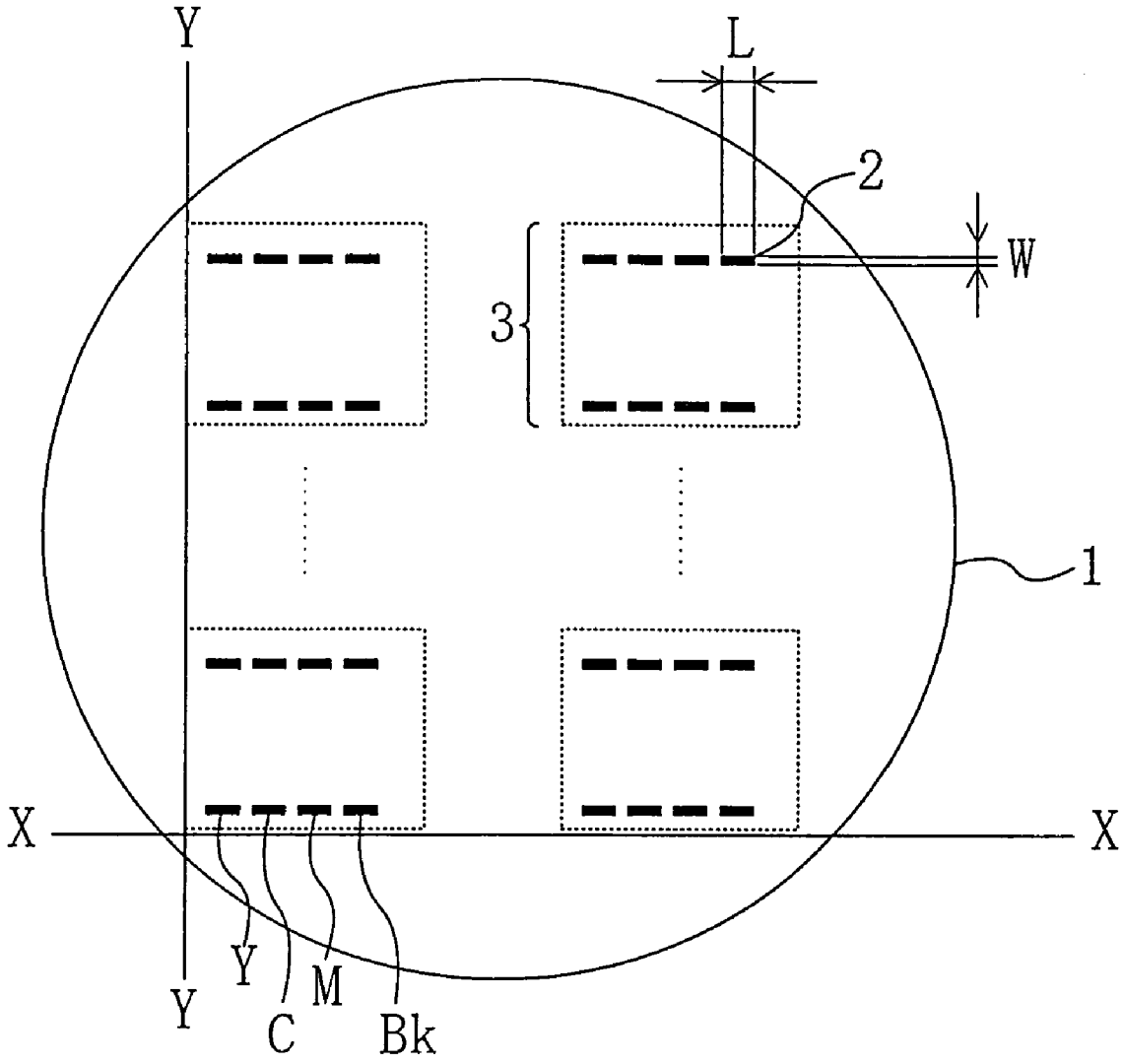
FIG. 2 is a top view illustrating inkjet heads.

The inkjet head 3 includes: a nozzle plate 11 provided with a plurality of nozzle holes 10, 10, . . . ; an ink chamber partition 8 for separating a plurality of ink chambers (pressure chambers) 8*a* from each other, which are provided on the nozzle plate 11, which are each communicated with the associated nozzle hole 10, and in which ink is contained; and a plurality of piezoelectric elements 14, 14, . . . , each provided to face, at its surface located at one side of a thickness direction, the associated ink chamber 8*a*, for pressurizing the ink contained in each ink chamber 8*a* to discharge the ink to the recording medium 29 from each nozzle hole 10 (see also FIGS. 2 and 3). The piezoelectric elements 14 are each formed by an oscillation layer (diaphragm layer) 7, a second electrode layer (common electrode layer) 6, a piezoelectric layer 5 and a first electrode layer (individual electrode layer) 4 which are stacked in this order. The first electrode layer 4 is formed so that its position (shape) corresponds to the position (shape) of the associated ink chamber 8*a*. A space, surrounded by the oscillation layer 7, ink chamber partition 8 and nozzle plate 11, forms the ink chamber 8*a*. A set of the nozzle hole 10, ink chamber 8*a* and piezoelectric element 14 form a single inkjet mechanism 2.

-Method for Fabricating Inkjet Head-

In this embodiment, the above-described inkjet head 3 is fabricated by the following method. Specifically, as shown in FIG. 2, 4 columns and 100 rows of inkjet mechanisms 2, each provided with an ink chamber 8*a* having a width (W) of 0.08 mm and a length (L) of 1.0 mm, are arranged at a widthwise pitch of 0.169 mm and a lengthwise pitch of 1.5 mm on a silicon substrate 1 having a diameter of 100 mm, a thickness of 0.53 mm and a (100) plane. Thus, the inkjet head 3 having a nozzle density of 150 dots per inch is fabricated. Furthermore, in this case, 9 columns and 3 rows of the inkjet heads 3 (i.e., 27 inkjet heads 3), which are 27 times as many as the conventional one, are fabricated at a time on the silicon substrate 1. It should be noted that in FIG. 2, a column Y represents the inkjet mechanisms 2 for discharging yellow ink, a column C represents the inkjet mechanisms 2 for discharging cyan ink, a column M represents the inkjet mechanisms 2 for discharging magenta ink, and a column Bk represents the inkjet mechanisms 2 for discharging black ink.

Figure 3A:
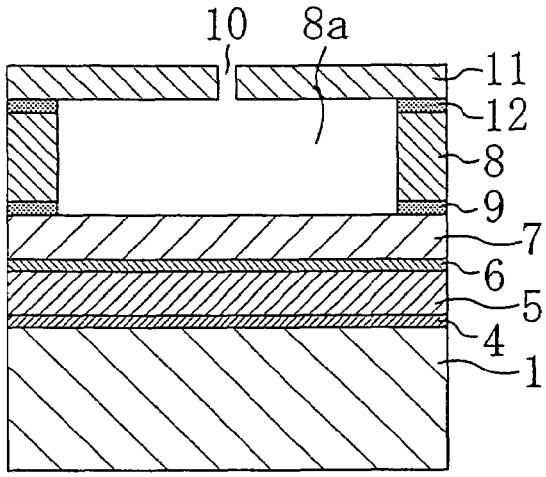
FIG. 3 shows diagrams illustrating respective process steps for fabricating an inkjet head.

Hereinafter, the details of a method for fabricating the above-described inkjet head 3 will be described. First, as shown in FIG. 3A, a first electrode layer 4 made of platinum (Pt) and having a thickness of 0.2 μm is formed on a silicon substrate 1. This first electrode layer 4 is deposited by carrying out sputtering for 10 minutes within an argon gas at 1 Pa while the silicon substrate 1 is heated to 650° C.

Next, a piezoelectric layer 5 made of lead zirconate titanate ($PbZr_{0.53}Ti_{0.47}O_3$) and having a thickness of 2.5 μm is formed on the first electrode layer 4. This piezoelectric layer 5 is deposited by carrying out sputtering for 2 hours within a mixture of argon and oxygen gases (with an Ar—$O_2$ gas volume ratio of 19-1) at 0.3 Pa while the silicon substrate 1 is heated to 650° C.

Then, a second electrode layer 6 made of platinum and having a thickness of 0.2 μm is formed on the piezoelectric layer 5 under the sputtering conditions similar to those for the first electrode layer 4. Thereafter, an oscillation layer 7 made of zirconium oxide ($ZrO_2$) and having a thickness of 3 μm is formed on the second electrode layer 6. This oscillation layer 7 is deposited by carrying out sputtering for 2 hours within a mixture of argon and oxygen gases (with an Ar—$O_2$ gas volume ratio of 10-1) at 0.5 Pa while the silicon substrate 1 is heated to 650° C. Thus, a head layer in which the first electrode layer 4, piezoelectric layer 5, second electrode layer 6 and oscillation layer 7 are stacked in this order is formed.

Subsequently, an ink chamber partition 8 made of Ni is pasted onto the oscillation layer 7 of the head layer via an adhesive 9 made of thermosetting resin. Then, a pressure of 0.1 kg/cm$^2$ is applied to the ink chamber partition 8 at 80° C. for 60 minutes, and thus the oscillation layer 7 and ink chamber partition 8 are adhered and fixed to each other. Next, a nozzle plate 11 provided with a plurality of nozzle holes 10, 10, . . . is pasted and fixed onto the ink chamber partition 8 via an adhesive 12, thereby forming a plurality of ink chambers 8*a*, 8*a*, . . . each communicated with the associated nozzle hole 10.

Figure 3B:
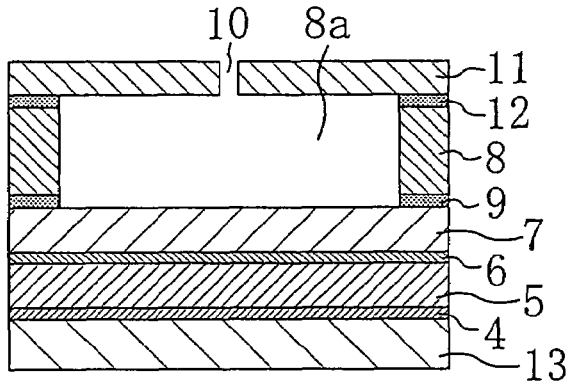
Figure 3C:
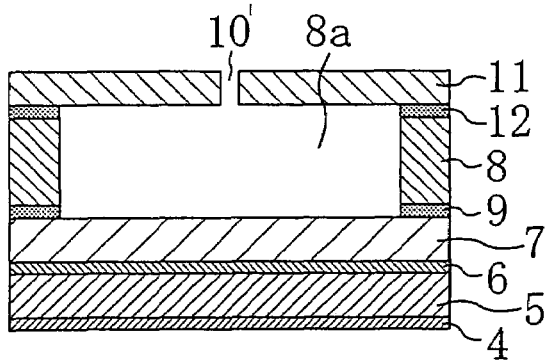

Then, as the feature of the present invention, a part of the silicon substrate 1 is ground away using a grinder (not shown) at a process speed of 0.05 mm per minute from a surface, of the silicon substrate 1 opposite to the first electrode layer 4, as shown in FIG. 3B. This grinding is carried out until the thickness of the silicon substrate 1 becomes 0.03 mm. Furthermore, this grinding operation requires 10 minutes. Thereafter, as shown in FIG. 3C, a dry etching apparatus that uses an $SF_6$ gas as an etching gas is utilized to perform dry etching, thus removing a remnant silicon substrate 13. This dry etching operation requires 15 minutes. That is, a period of time required for the removal of the entire silicon substrate 1 is 25 minutes in total.

Figure 3D:
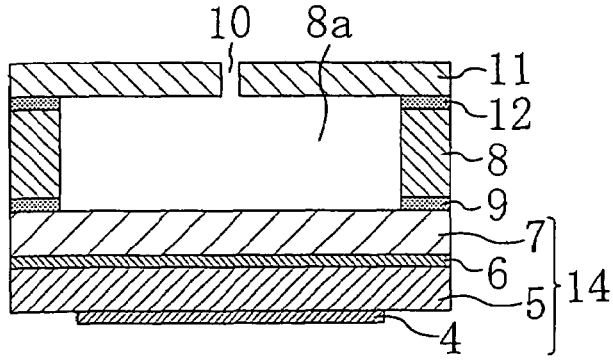
Figure 4A:
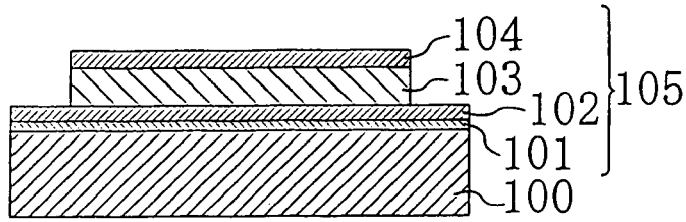
FIG. 4A PRIOR ART
FIG. 4 shows diagrams illustrating respective process steps for fabricating a conventional inkjet head.
Figure 4B:
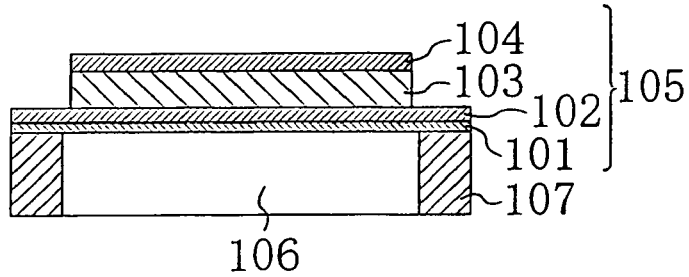
FIG. 4B PRIOR ART
Figure 4C:
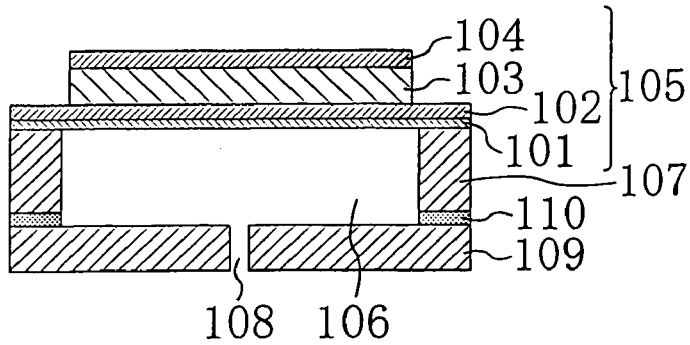
FIG. 4C PRIOR ART
Figure 5A:
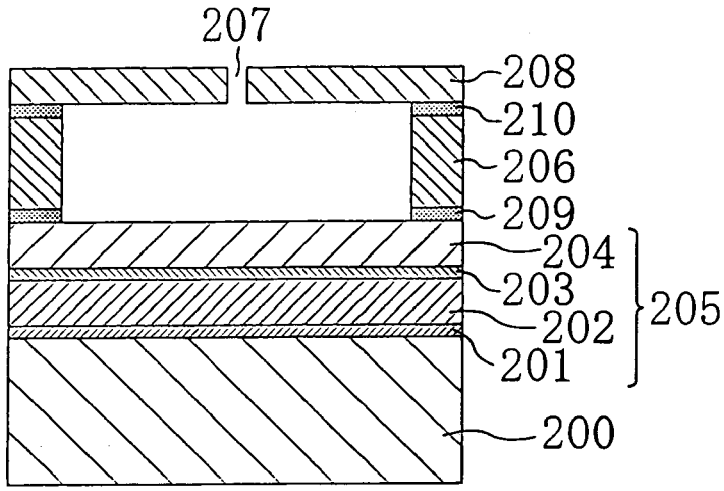
FIG. 5A PRIOR ART
FIG. 5 shows diagrams illustrating respective process steps for fabricating another conventional inkjet head.
Figure 5B:
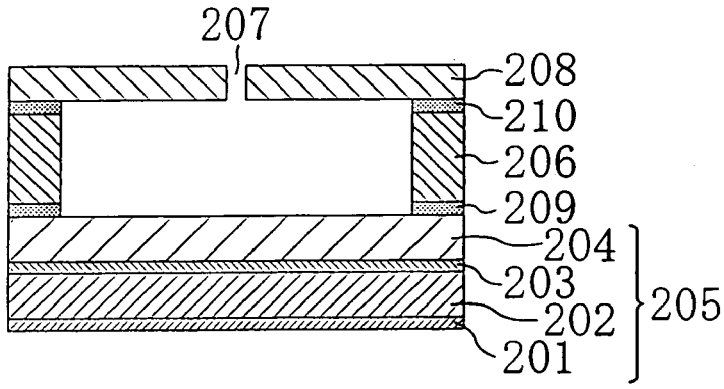
FIG. 5B PRIOR ART

Subsequently, as shown in FIG. 3D, the exposed first electrode layer 4 is patterned (individualized) so that its position corresponds to that of the associated ink chamber 8*a*, thereby forming the individualized first electrode layer 4 and forming a plurality of piezoelectric elements 14, 14, . . . . Thus, a plurality of inkjet mechanisms 2, 2, . . . are formed.

Finally, the plurality of inkjet mechanisms 2, 2, . . . are cut and divided along the broken lines extending in the X—X line direction and the Y—Y line direction shown in FIG. 2, thereby forming 27 inkjet heads 3.

-Operation of Inkjet Head-

Hereinafter, the operation of the inkjet head 3 will be described. First, upon application of an electric signal between the first and second electrode layers 4, 6, the electric signal is converted into a mechanical signal at the piezoelectric layer 5, and the piezoelectric element 14 is deformed so as to reduce the volume of the ink chamber 8*a*. Then, due to this deformation, the ink contained in the ink chamber 8*a* is discharged from the nozzle hole 10.

COMPARATIVE EXAMPLE

Hereinafter, a method for fabricating an inkjet head according to a comparative example will be described. In the fabricating method of the comparative example, the removal of a silicon substrate is carried out by only dry etching, and in regard to the other points, this fabricating method is substantially similar to the fabricating method according to the present embodiment. Specifically, first, a head layer is formed by sequentially stacking a first electrode layer, a piezoelectric layer, a second electrode layer and an oscillation layer over a silicon substrate having a diameter of 100 mm, a thickness of 0.53 mm, and a (100) plane. Then, an ink chamber partition and a nozzle plate are sequentially bonded and fixed onto the oscillation layer, and thereafter the silicon substrate is removed by only dry etching.

According to this comparative example, a period of time required for the removal of the silicon substrate is 260 minutes, which is 10 times greater than the time period required in the present embodiment (25 minutes) in which mechanical grinding is performed in combination with dry etching. Further, since the time period required for the dry etching is long, the temperature of an inkjet head increases during the removal, thereby causing the degradation of an adhesive. Furthermore, since the time period required for the removal of the silicon substrate is long, an etch rate difference due to the distribution of plasma in the dry etching is increased, thus causing a difference of 20 minutes or more in the time period required for the completion of removal of a central part and a peripheral part of the silicon substrate. As a result, the etched amount of the first electrode layer is varied. Due to these process problems, a difference of 10% or more in ink discharge characteristic is caused between the simultaneously fabricated inkjet heads. In addition, if the fabrication of the inkjet heads is carried out 10 times using the silicon substrate with a diameter of 100 mm, defective products are fabricated due to etching residue. Besides, these defective products make up 10% of the total products.

-Effects-

To the contrary, according to the present embodiment, since the time period required for the removal of the silicon substrate 1 can be shorter than that in the comparative example, the productivity of the inkjet heads 3 can be improved.

Further, since the time period required for dry etching is shorter than that in the comparative example, the temperature increase during the process is only 30° C.

Furthermore, since the remnant silicon substrate 13 is thin, the difference of etching completion time of the central part and peripheral part of the silicon substrate 1 due to the distribution of plasma is only 1 minute. Therefore, the degradation in the first and second electrode layers 4, 6, adhesives 9,12, piezoelectric layer 5, oscillation layer 7, ink chamber partition 8 and nozzle plate 11 is reduced. As a result, variations in the ink discharge speed between the simultaneously produced inkjet heads 3, 3, . . . fall within 3%.

In addition, since the grinding is carried out before the dry etching is performed, the contamination of the surface of the silicon substrate 1 opposite to the first electrode layer 4 (the surface of the silicon substrate 1 to be dry etched) is removed, and thus occurrence of etching residue can be suppressed. Therefore, even if the fabrication of the inkjet heads 3 is carried out 10 times using the silicon substrate 1 with a diameter of 100 mm, no defective products resulting from the etching residue are fabricated.

Moreover, since platinum whose etch rate during dry etching is low is used for the first electrode layer 4, it is possible to certainly remove only the silicon substrate 1 without removing the first electrode layer 4.

Besides, according to the fabricating method of the present embodiment, a plurality of the inkjet heads 3, in which variations in the heights of the ink chambers 8*a* are slight, can be simultaneously fabricated using the silicon substrate 1 having a large thickness, for example.

Further, since the inkjet heads 3 according to the present embodiment are fabricated by the above-described method, variations in the heights of the ink chambers 8*a* are slight, and therefore, printing irregularities during printing are reduced in the inkjet recording apparatus P according to the present embodiment.

(Other Embodiments)

It should be noted that although lead zirconate titanate ($PbZr_{0.53}Ti_{0.47}O_3$) is used for the piezoelectric layer 5, the present invention is not limited to this. The effects similar to those of the present embodiment are achievable even if a material with a high piezoelectric constant such as $PbZr_{0.7}Ti_{0.3}O_3$~$PbZr_{0.4}Ti_{0.6}O_3$, for example, in which a crystal system exists in the vicinity of the border between a rhombohedral system and a tetragonal system, is used. Further, even if a multicomponent material in which at least one of magnesium (Mg), niobium (Nb) and zinc (Zn) is added to lead zirconate titanate is used for the piezoelectric layer 5, the effects similar to those of the present embodiment can be achieved.

Furthermore, although platinum is used for the first electrode layer 4 in the present embodiment, the present invention is not limited to this. The effects similar to those of the present embodiment are achievable even if a material whose etch rate during dry etching is low, such as a simple substance consisting of any one of Ir, Pd, Au, Ni, Fe, Cu and Cr or an alloy including at least one of Pt, Ir, Pd, Au, Ni, Fe, Cu and Cr, is used.

Also, although platinum is used for the second electrode layer 6 in the present embodiment, the present invention is not limited to this. The effects similar to those of the present embodiment are achievable even if Al, Cr, Cu, Fe, Au, Ni, Ir or SUS is used.

In addition, although Ni is used for the ink chamber partition 8 in the present embodiment, the present invention is not limited to this. The effects similar to those of the present embodiment are achievable even if crystallized glass, Si, SUS, photosensitive glass, or MgO is used.

Besides, although the ink chamber partition 8 is bonded and fixed onto the oscillation layer 7 via the adhesive 9 in the present embodiment, the present invention is not limited to this. For example, the ink chamber partition 8 may alternatively be formed on the oscillation layer 7 as follows. Specifically, first, a dry film as a model is formed on the oscillation layer 7, and then the ink chamber partition 8 is formed to a thickness of 0.15 mm on the oscillation layer 7 by employing electroplating. Next, the height of the ink chamber partition 8 is matched to that of the dry film by grinding or polishing, for example. Finally, the dry film is removed, thereby completing the ink chamber partition 8. In this case, an adhesive for bonding the oscillation layer 7 and the ink chamber partition 8 together is not necessary. It should be noted that the step of performing grinding or polishing and the step of removing the dry film may be carried out in the reverse order. Alternatively, in the step of forming the ink chamber partition 8, electroless plating, for example, may be used instead of electroplating. In that case, the step of performing grinding or polishing is not necessary.

Further, although zirconium oxide is used for the oscillation layer 7 in the present embodiment, the present invention is not limited to this. The effects similar to those of the present embodiment are achievable even if aluminum oxide, silicon oxide, Cr, SUS, or Ni is used. In that case, if a conductive material such as Cr, SUS or Ni is used for the oscillation layer 7, the oscillation layer 7 functions as the second electrode layer, and thus it becomes unnecessary to additionally provide the second electrode layer.

Furthermore, it is preferable that the piezoelectric layer 5 has a thickness of 1 μm to 10 μm. This is because if the thickness is less than 1 μm, a large displacement amount cannot be obtained. On the other hand, if the thickness exceeds 10 μm, the irregularities of a surface of the piezoelectric layer 5 are increased to make it difficult to form the planar second electrode layer 6, and as a result, it becomes difficult to stably fabricate the piezoelectric elements 14 in which variations in the displacement amount are slight.

In addition, although the silicon substrate 1 has a diameter of 100 mm and a thickness of 0.53 mm in the present embodiment, the present invention is not limited to this. For example, the effects similar to those of the present embodiment are achievable even if the silicon substrate 1 has a thickness 100 times greater than that of the head layer. Further, the area of the silicon substrate 1, the thickness of the silicon substrate 1, the thickness to which the silicon substrate 1 is ground away, and the thickness of the remnant silicon substrate 13 can be arbitrarily set for each purpose.

Furthermore, although only the first electrode layer 4 is patterned in the present embodiment, the present invention is not limited to this. Alternatively, the piezoelectric layer 5 may also be patterned in addition to the first electrode layer 4.

Moreover, although 27 inkjet heads 3 are formed by dividing the plurality of inkjet mechanisms 2, 2, . . . in the present embodiment, the present invention is not limited to this. Alternatively, a single inkjet head 3 may be formed out of the plurality of inkjet mechanisms 2, 2, . . . , or two or more inkjet heads 3 may be formed by dividing the plurality of inkjet mechanisms 2, 2, . . . .

Besides, the nozzle plate 11 is formed on the ink chamber partition 8 after the ink chamber partition 8 has been formed on the oscillation layer 7 in the present embodiment, the present invention is not limited to this. For example, the nozzle plate 11 may be formed on the ink chamber partition 8 after the first electrode layer 4 has been patterned.

In addition, although the fabricating method according to the present invention is applied to the inkjet heads 3 of a so-called serial type inkjet recording apparatus p in the present embodiment, the present invention is not limited to this. Alternatively, the inventive fabricating method may be applied to the inkjet heads of a so-called line type inkjet recording apparatus.

Further, although the remnant silicon substrate 13 is removed by dry etching using an $SF_6$ gas in the present embodiment, the present invention is not limited to this. Alternatively, the remnant silicon substrate 13 may be removed by dry etching using an etching gas containing a halogen such as fluorine or chlorine.

Furthermore, although the remnant silicon substrate 13 is removed by dry etching in the present embodiment, the present invention is not limited to this. Alternatively, the remnant silicon substrate 13 may be removed by wet etching. However, if the remnant silicon substrate 13 is removed by wet etching, the adhesives 9,12 are damaged, and therefore, it is preferable to utilize dry etching in removing the substrate.

INDUSTRIAL APPLICABILITY

As described above, the present invention is useful, for example, in the case where inkjet heads are simultaneously mass-produced.

The invention claimed is:

1. A method for fabricating an inkjet head comprising a plurality of piezoelectric elements, each having a first electrode layer, a piezoelectric layer, a second electrode layer and an oscillation layer, for pressurizing ink contained in a plurality of ink chambers to discharge the ink to a recording medium from a plurality of nozzles communicated with the respective ink chambers, the method characterized by comprising the steps of:

sequentially forming the first electrode layer, the piezoelectric layer, the second electrode layer and the oscillation layer over one surface of a substrate;

forming, on the oscillation layer, an ink chamber partition for separating the plurality of ink chambers from each other;

forming, on the ink chamber partition, a nozzle plate provided with the plurality of nozzles, thereby defining the plurality of ink chambers;

after the ink chamber partition forming step, mechanically grinding away a part of the substrate from a surface thereof opposite to the first electrode layer;

after the grinding away step, etching away a remnant substrate; and after the etching away step, patterning at least the first electrode layer so that a position of the first electrode layer corresponds to that of an associated one of the ink chambers, thereby forming the plurality of piezoelectric elements.

2. The inkjet head fabricating method according to claim 1, the method characterized in that:

the first electrode layer comprises at least one of Pt, Ir, Pd, Au, Ni, Fe, Cu and Cr; and in the etching away step, the remnant substrate is dry etched away.

* * * * *